US008341904B2

(12) United States Patent
Galas

(10) Patent No.: US 8,341,904 B2
(45) Date of Patent: Jan. 1, 2013

(54) FIXING SYSTEM FOR SKIRTING

(76) Inventor: Adam Slawomir Galas, Bialystok (PL)

( * ) Notice: Subject to any disclaimer, the term of this patent is extended or adjusted under 35 U.S.C. 154(b) by 0 days.

(21) Appl. No.: 12/954,580

(22) Filed: Nov. 24, 2010

(65) Prior Publication Data

US 2011/0126482 A1 Jun. 2, 2011

(30) Foreign Application Priority Data

Nov. 26, 2009 (PL) ..... 389677

(51) Int. Cl.
*E04B 2/00* (2006.01)

(52) U.S. Cl. ..... 52/288.1; 52/282.1; 52/287.1

(58) Field of Classification Search ..... 52/288.1, 52/281, 282.1, 287.1, 285.3
See application file for complete search history.

(56) References Cited

U.S. PATENT DOCUMENTS

| | | | | |
|---|---|---|---|---|
| 3,748,815 | A * | 7/1973 | Parker | 52/714 |
| 5,836,113 | A * | 11/1998 | Bachman | 52/94 |
| 6,115,892 | A | 9/2000 | Malin et al. | |
| 6,115,982 | A * | 9/2000 | Lindenberg | 52/506.05 |
| 6,625,941 | B2 * | 9/2003 | Shaw | 52/211 |
| 6,643,987 | B2 * | 11/2003 | Rusch et al. | 52/506.05 |

FOREIGN PATENT DOCUMENTS

| | | |
|---|---|---|
| DE | 7118270 | 9/1971 |
| DE | 21 23 154 | 11/1972 |
| DE | 3408784 | 9/1985 |
| DE | 93 01 324 | 4/1993 |
| PL | 200819 | 3/1999 |
| PL | 381507 | 7/2008 |
| RU | 63458 | 2/2002 |

OTHER PUBLICATIONS

European Search Report in Application No. 10191840.7, dated Jul. 19, 2012 in 7 pages.

* cited by examiner

*Primary Examiner* — Jeanette E Chapman
*Assistant Examiner* — Daniel Kenny
(74) *Attorney, Agent, or Firm* — Knobbe Martens Olson & Bear, LLP

(57) ABSTRACT

An object of the present invention is a fixing system for a skirting, more particularly for a skirting board, in form of a wall finish, more particularly the wall finish of a floor, comprising a joint element, the flat base wall of which is located under a panel, more particularly under the floor board, being separably connected to a skirting profile element. The joint element is an flexible element and is bent in an arch, wherein the free end of an arm of the joint element is clickway connected to the base arm of the skirting profile element.

12 Claims, 10 Drawing Sheets

FIXING SYSTEM FOR SKIRTING

CROSS-REFERENCE TO RELATED APPLICATIONS

This application claims priority from Polish patent application no. P 389 677, filed on Nov. 26, 2009, which is fully incorporated by reference herewith

BACKGROUND OF THE INVENTION

1. Field of the Invention

An object of the present invention is fixing system of a skirting, more particularly for fixing skirting boards, or a baseboard.

2. Description of the Related Art

From the description of Polish Utility Model No. 63458Y1 is known an overlap guard structure, having an assembly skirting, being placed under the surface layer, constituting a fixing element of a guard skirting, being immovable connected to this fixing element. The assembly skirting is fixed on the base by means of an adhesive.

Polish Patent No. 200819 discloses a structure of a fixing system of a skirting which comprises at least one finish skirting and at least one assembly section. Between arms of the assembly section is inserted a fixing element, and more particularly a floor board. The assembly section is provided with a longitudinal protrusion to be found above its upper arm, and a gap which comes into being between that protrusion and the upper arm is used for fixing the finish skirting.

The structure of the above presented system allows to arrange a skirting without the necessity to fix it immovably on a base or on a wall by means of joint elements. Because of the structure of the assembly section, it is required that each time the thickness of a fixing element has to be fitted, more particularly the thickness of a floor board has to be fitted to an opening of a gap between arms of a channel section.

SUMMARY OF THE INVENTION

An object of the present invention is fixing system of a skirting, more particularly of a skirting board system, constituting a wall finish, more particularly the wall finish of a floor. This system comprises a joint element, the flat base wall of which is located under a panel, more particularly under the floor board, being separably connected to a skirting profile element.

The joint element is preferably an elastic or flexible element and is archway bended, wherein the free end of the arm of the joint element is clickway connected to the arm of the skirting profile element.

One embodiment of the invention provides a fixing system for skirting comprising a skirting profile element and a coupling element, the skirting profile element having an arm for connection to the coupling element, the coupling element comprising a first end portion that is substantially flat and adapted to be located under a flow element, and a second end portion configured to connect the coupling element to the arm of the skirting profile element, the coupling element being flexible and having a bent portion between the first and second end portions so that, in use the second end portion can engage the arm of the skirting profile element in a separable manner.

Advantageously, the joint element is provided with a reinforcing web and from the wall side it shows a flattening.

In accordance with the present invention, the joint element is provided with elastic inserts or with a level elastic element.

The base of the skirting profile element is provided with an upright resistance projection.

The solution in accordance with the present invention allows to arrange a skirting without the necessity of making openings in a base and in a wall, as required for application of joint elements, fixing the skirting. Due to the elastic features of the joint element, the fixing system according to the present invention is suitable for use with floor boards or other floor coverings, being different thicknesses.

Moreover, these features enable making use of a click joint between a skirting joint element and a skirting profile element. This click joint makes the assembly operations much easier.

The use of elastic inserts increases stability and safeness of the click joint, which is accomplished between an arm of the profile element base of the skirting and an upper arm of the joint. The elastic inserts prevent a dislocation of the joint as well as of the skirting profile element.

BRIEF DESCRIPTION OF THE DRAWINGS

The object of the present invention is presented by way of embodiments with reference to the accompanying drawings in which.

DETAILED DESCRIPTION OF THE PREFERRED EMBODIMENT

Figure 1:
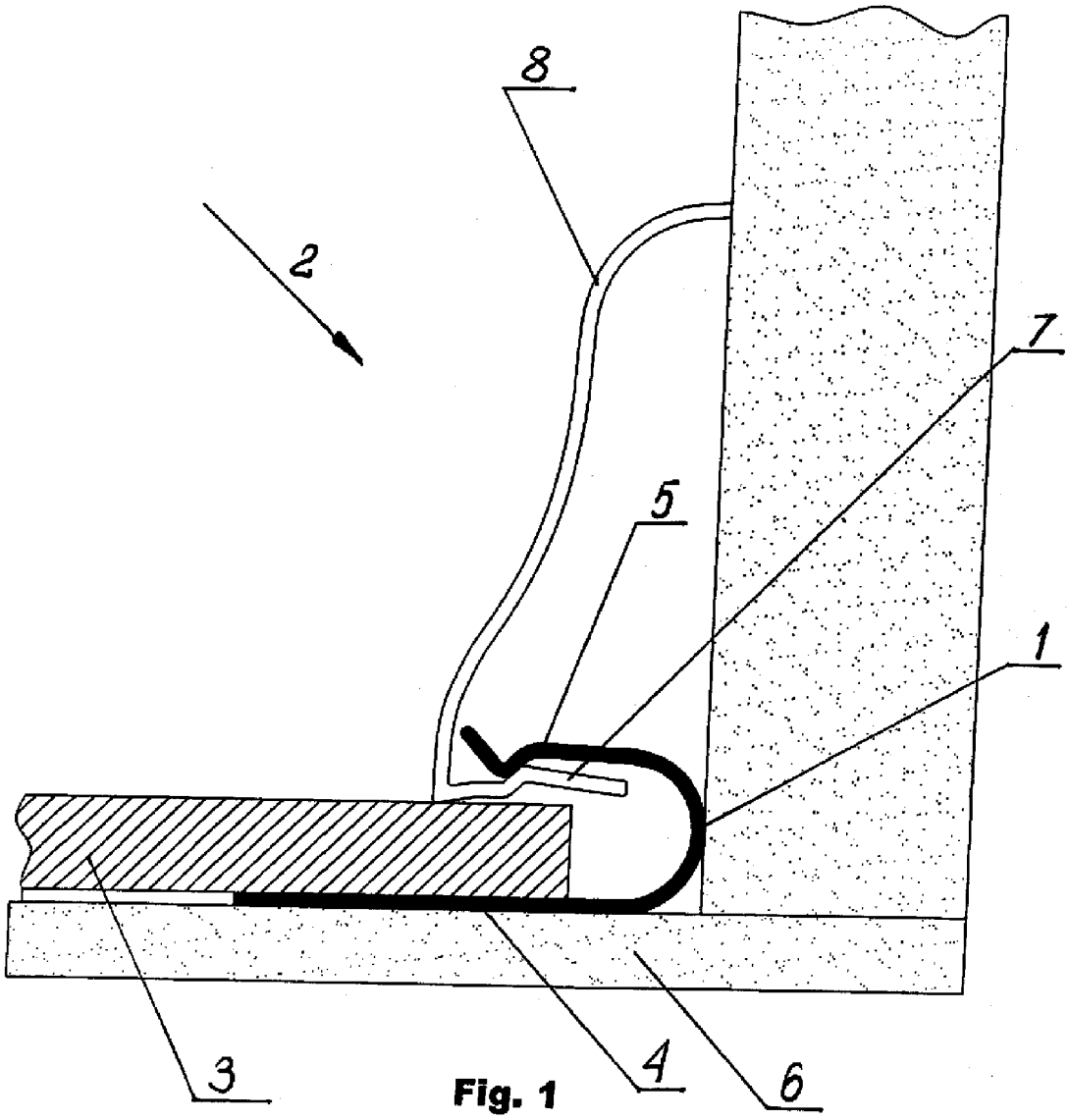
FIG. 1 shows schematically the fixing system of the skirting according to the present invention in a cross-section in its first embodiment.

As shown in FIG. 1 of the drawing, the fixing system according to the present invention comprises the joint element 1 as made of elastic material, advantageously of metal or plastic and the skirting profile element 2, more particularly being made of plastic material. This element consists of the guard arm 8, being upwardly located and resting on a wall, as well as of a base arm, resting on a floor covering. The base arm 7 shows the undercutting 12, constituting a part of the click joint, fixing the skirting profile element. The guard part 8 of the skirting profile element may become different shapes, depending on the scope of the application of the skirting and on its appropriation.

By way of example, from the inner side it may be provided with channels for arranging different kinds of conductors, and its outer surface may be appropriate finished, according to the nature of the interior in which the skirting is arranged.

The joint element 1 is provided with the lower flat wall 4 which is down- and upwardly deflected in an archway and which ends with the upper arm 5 in the triangular recess 11, constituting a click joint with the undercutting 12 in the base arm 7 of the profile element 2 of the skirting. In the above-presented structure, the shape of the joint element 1 in the end view is nearing the U-shape.

The lower flat wall 4 of the joint element 1 is in this embodiment longer than the upper arm and is located under the floor layer 3 in form of panels, wool flooring, glass or ceramic plates and the like, stiff floor coverings, being arranged on the base 6.

Figure 2:
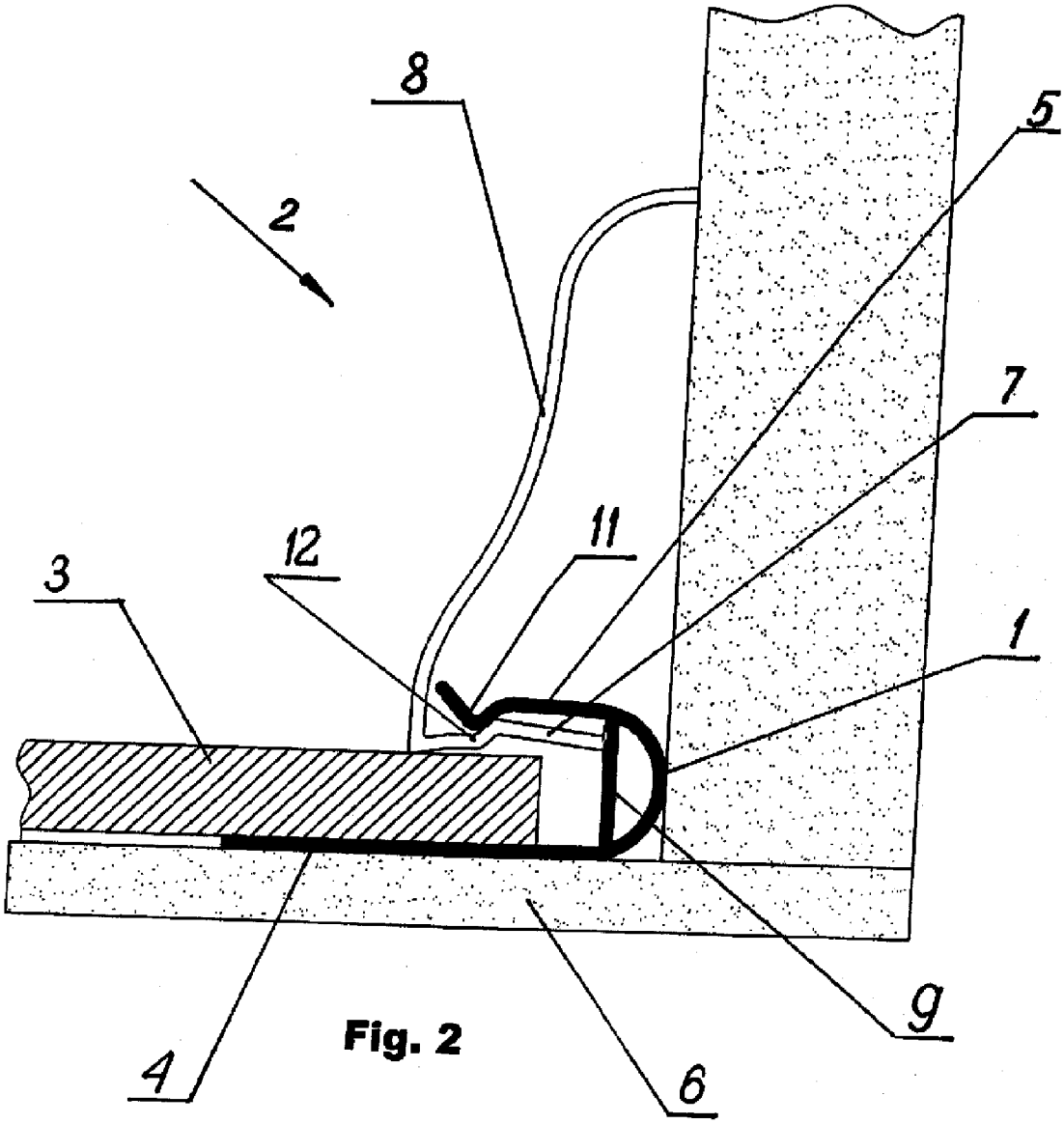
FIG. 2 shows the fixing system according to the present invention in its second embodiment.

FIG. 2 shows the fixing system of the skirting according to the present invention as shown in FIG. 1, wherein the difference is that the joint element 1 is provided with the strengthening web 9 which makes the structure of this element stiffer. Moreover, this web constitutes support for the end of the base arm 7 of the skirting profile element 2.

Figure 3:
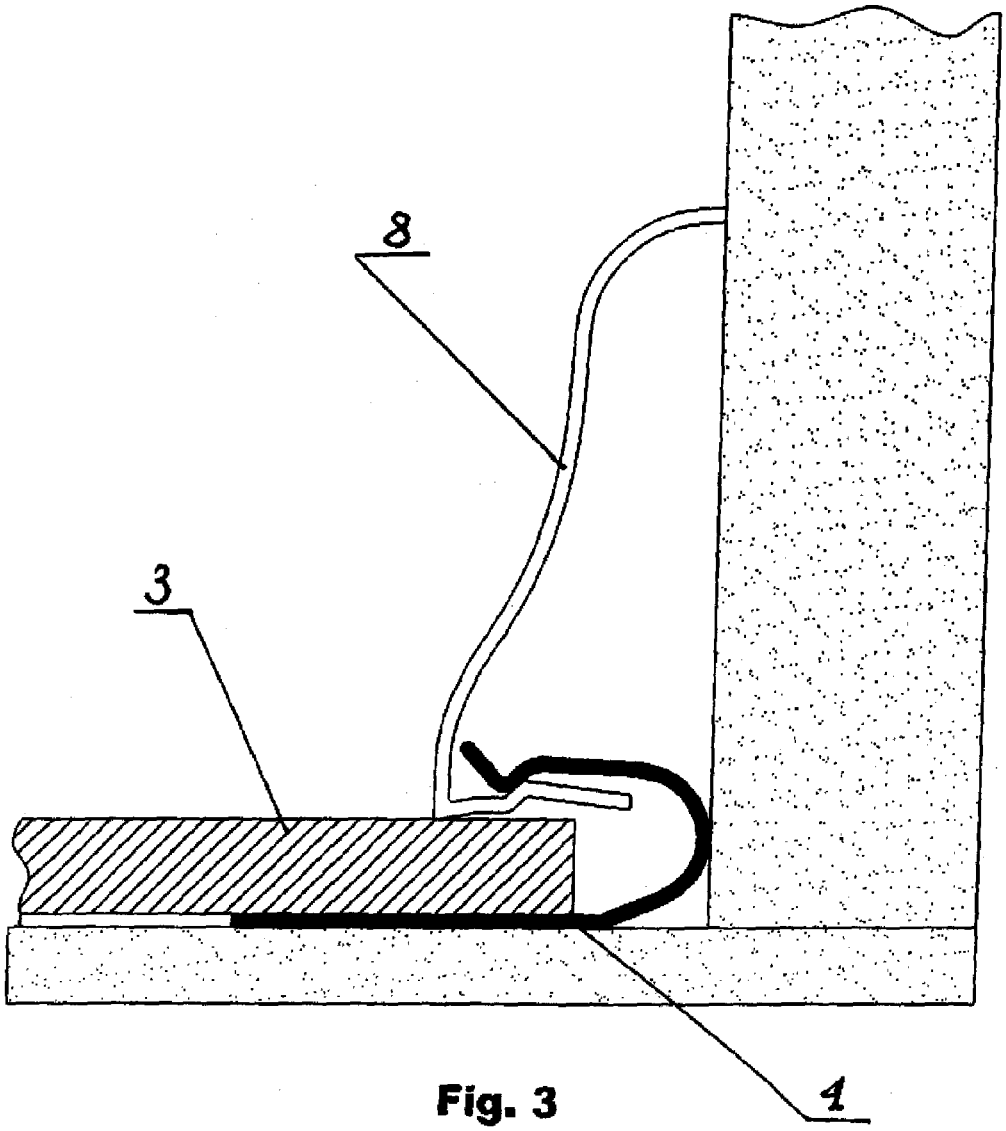
FIG. 3 shows the fixing system according to the present invention in its third embodiment.
Figure 4:
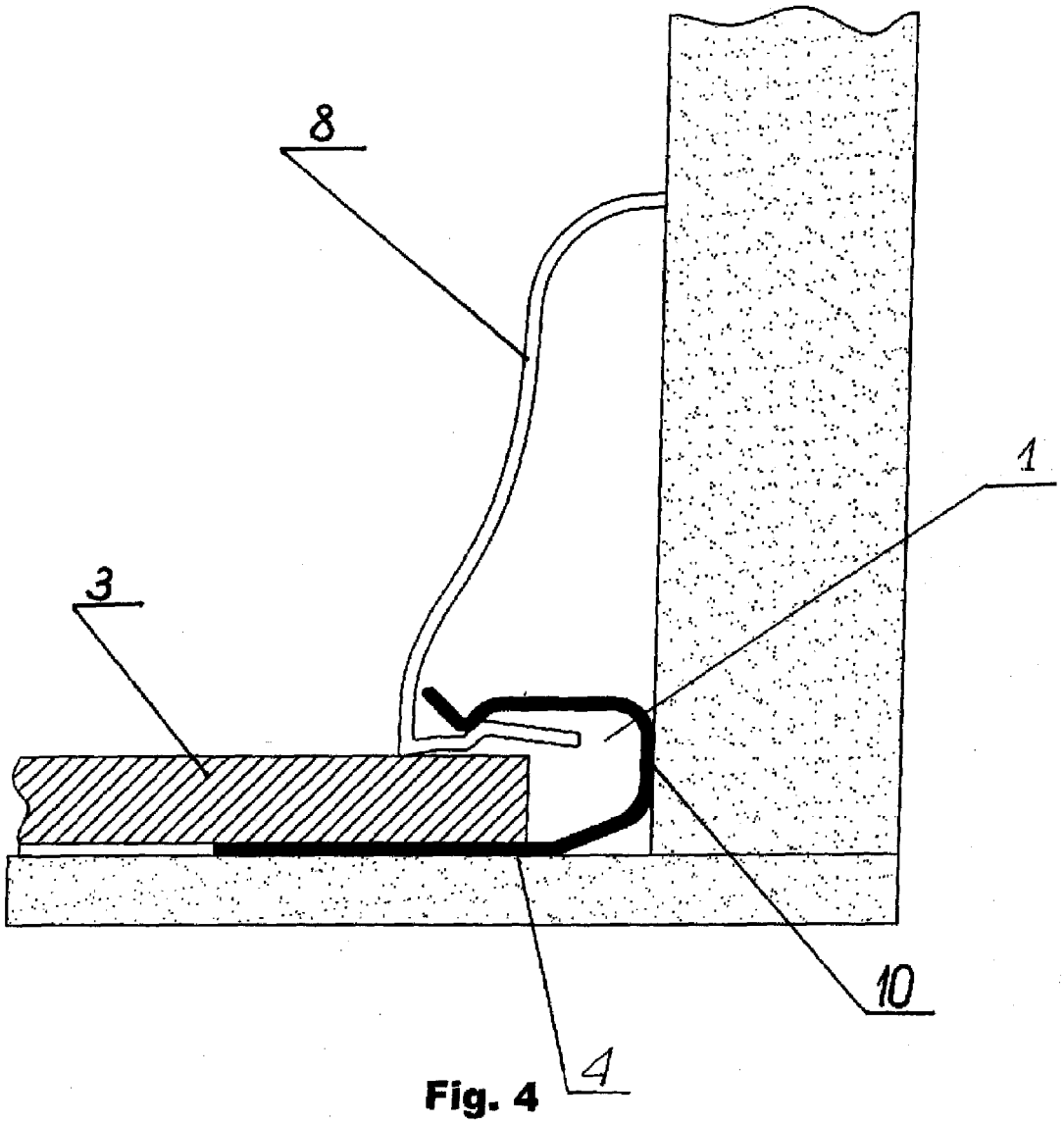
FIG. 4 shows the fixing system according to the present invention in its fourth embodiment.

As it is shown in FIGS. 3 and 4, the fixing system of the skirting according to the present invention is provided with the lower wall 4 of the joint element 1, being upwardly deflected at an angle and additionally, in the solution according to FIG. 4, the joint element 1 is provided with the flattening 10, being made from the wall side. This flattening meets the wall on which the skirting according to the present invention is arranged.

Figure 5:
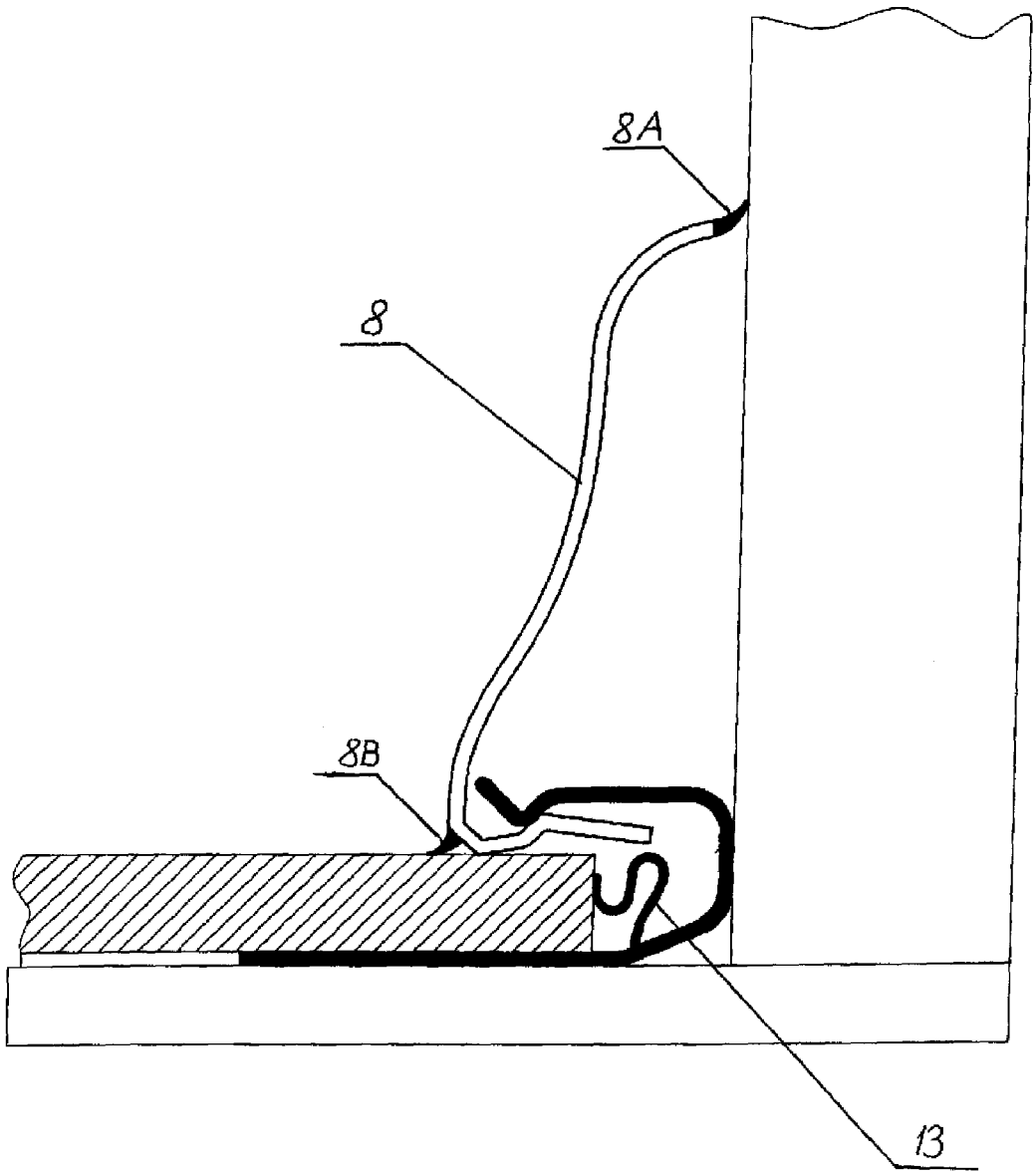
FIG. 5 shows the fixing system according to the present invention in its fifth embodiment.
Figure 5A:
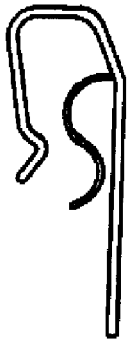
FIG. 5A is an end view of the joint element of the fixing system of FIG. 5.

The guard arm 8 of the skirting profile element 2 as shown in the solution according to FIG. 5 is provided with longitudinal edges 8*a* and 8*b*, being made of soft plastic and by means of which the guard arm 8 is properly supported on the wall and on the floor 3. These edges make it possible that the guard profile, being assembled on the interior wall is properly fitted. The joint element 1 is in this embodiment provided with the S-shaped elastic insert 13 which, as it is shown in FIG. 5A, is fixed to the lower wall 4 of the joint element 1 and in the unstressed state it protrudes beyond the upper arm 5. As it is shown in FIG. 5, free end of the insert is in the fixed state supported on the upright floor space 3.

Figure 6A:
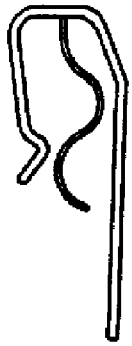
FIG. 6A is an end view of the joint element of the fixing system of FIG. 6.
Figure 6:
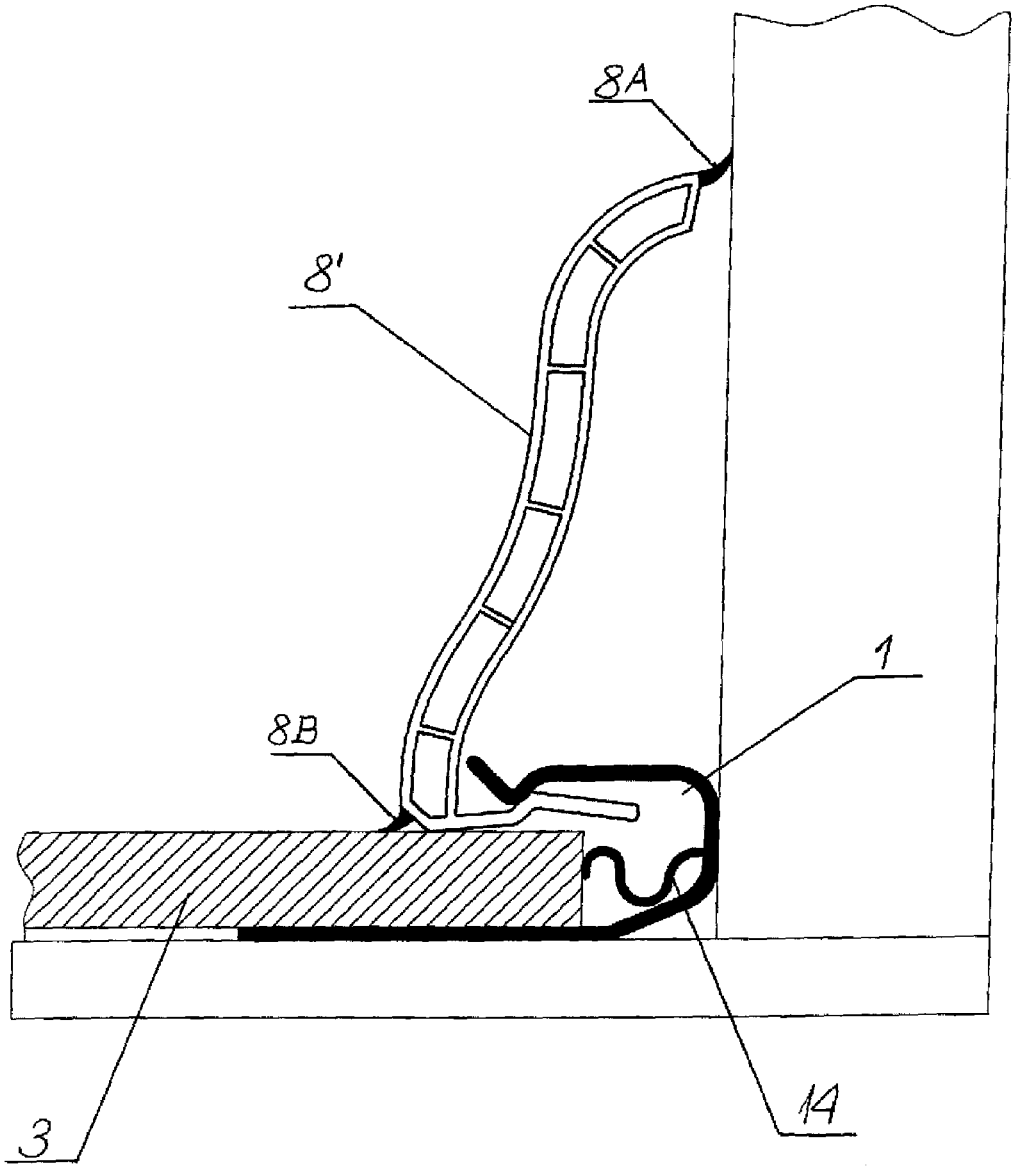
FIG. 6 shows the fixing system according to the present invention in its sixth embodiment.

In FIG. 6 is shown the fixing system according to the present invention which is provided with the guard arm 8', having a box structure and is provided with longitudinal edges 8*a*, 8*b*, being made of soft plastic. To the flattening 10 of the joint element 1 is attached the S-shaped elastic insert 14, being in the fixed state with another end supported on the upright floor space 3. As it is shown in FIG. 6*a*, the insert 14 protrudes in the unstressed state beyond the upper arm 5.

Figure 7:
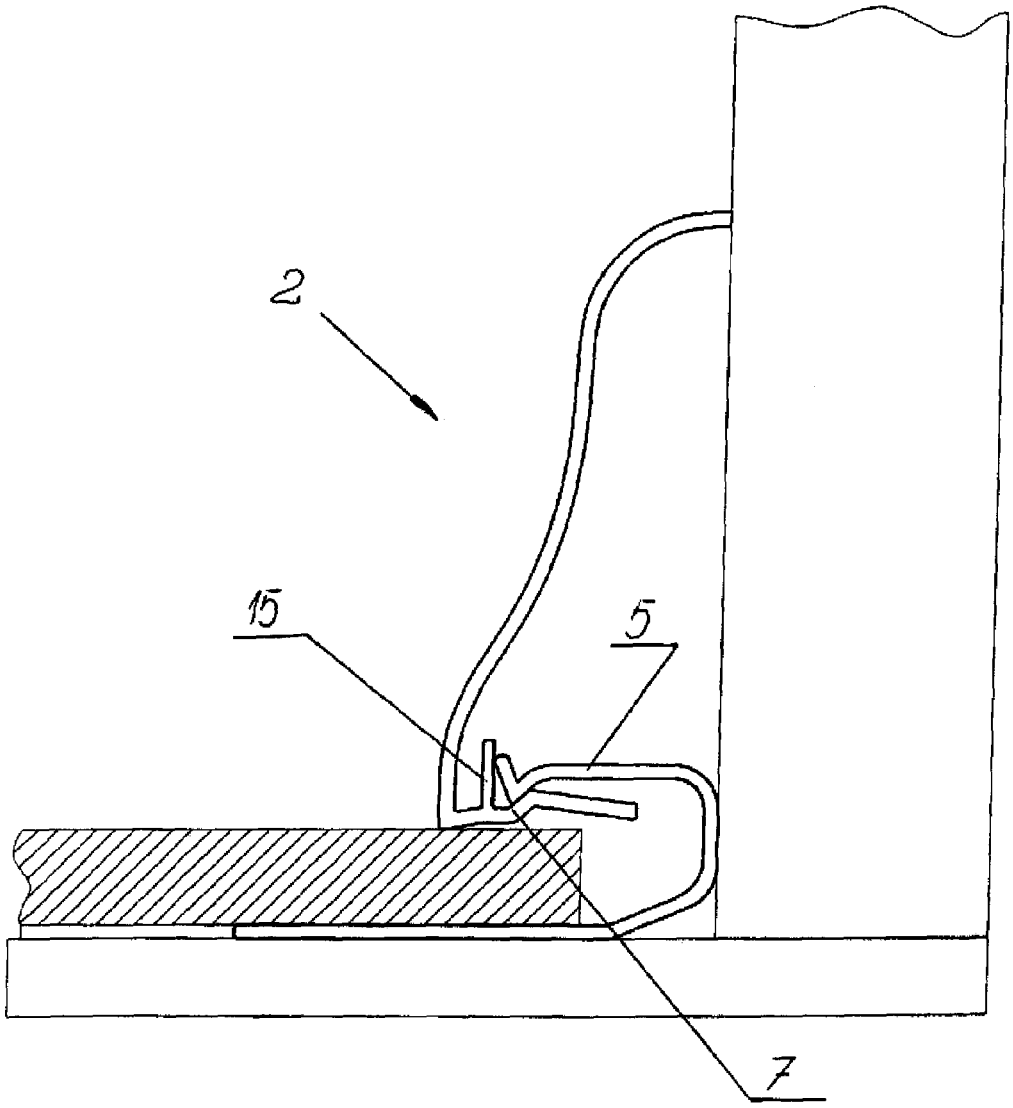
FIG. 7 shows the fixing system in accordance with the present invention in its seventh embodiment.

Due to the solution according to FIG. 7, the base arm 7 of the profile element 2 is from above provided with the upright longitudinal resistance protrusion 15, constituting support for the end of the upper arm 5 of the joint element 1. The protrusion 15 may constitute a continuous element or may be divided into many protrusions along the base arm 7.

Figure 8A:
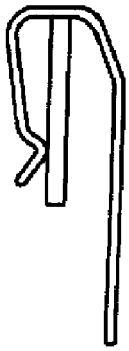
FIG. 8A is an end view of the joint element of the fixing system of FIG. 8
Figure 8:
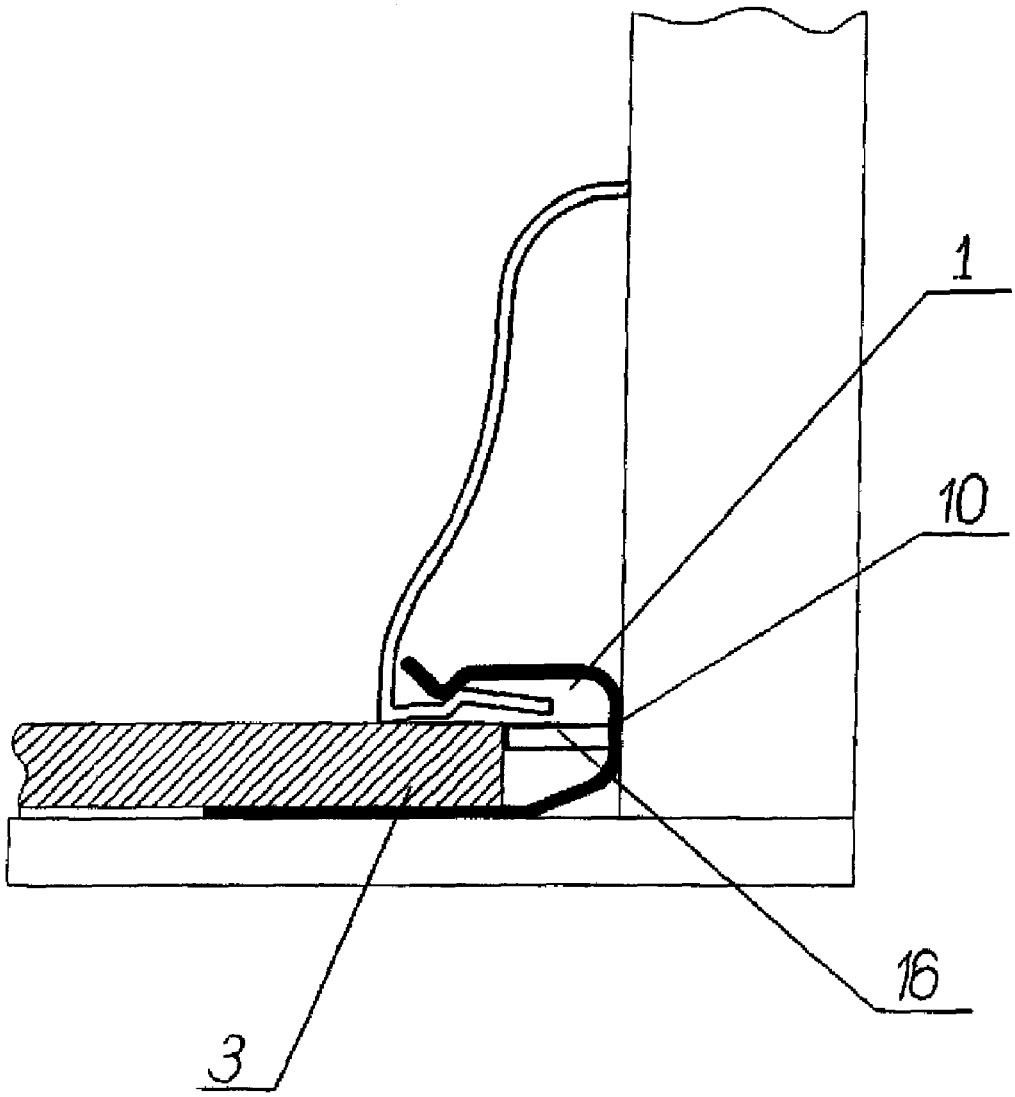
FIG. 8 shows the fixing system in accordance with the present invention in its eighth embodiment.

In the embodiment of the present invention according to FIG. 8, the joint element 1 is provided with the level elastic element 16, protruding out of the flattening 10. After arranging the skirting, the elastic element 16 rests with its end on the upright floor space 3. Structure details of the joint element 1 according to the embodiment of FIG. 8 are shown in FIG. 8*a*.

Figure 9:
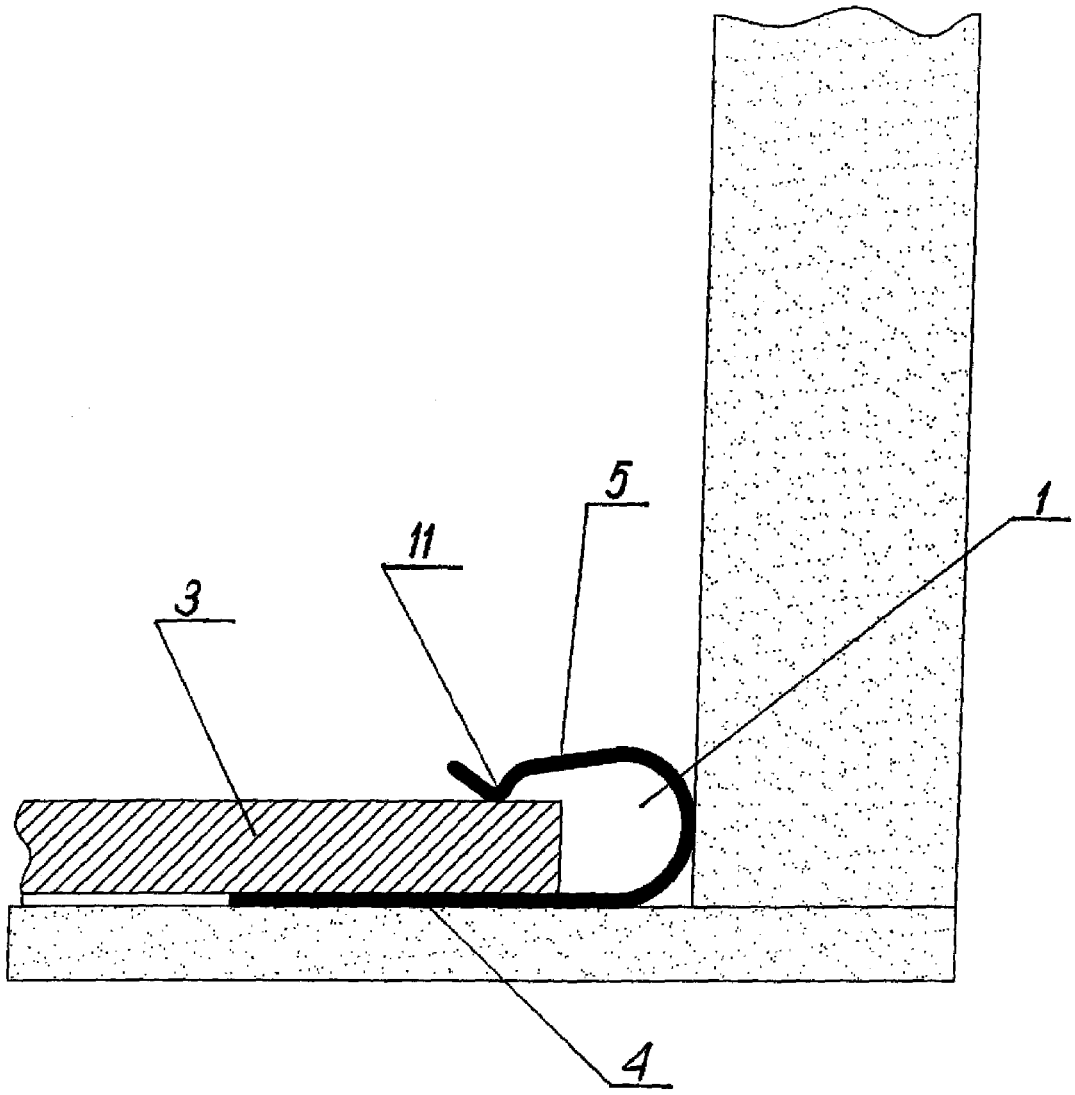
FIG. 9 shows as an example the first assembly stage of the fixing system of the skirting according to the present invention.

Below will be presented the manner of assembling the skirting according to the present invention. The assembly starts with fixing the joint element 1 on the base. In case when it is required because of existing circumstances, the joint element 1 may be fixed on the base 6 by means of an adhesive. Afterwards, floor board is arranged on the lower wall 4 of the joint element 1 and as it is shown as an example in FIG. 9, it is inserted under the arm 5 of this element. Due to its elasticity, the joint element 1 enables the use of the fixing system in case of floor boards, having different thickness, as the arm 5 of this element may be deflected from the lower wall 4 for a certain distance. The base arm 7 is fixed on the surface of the upper floor board and it is so long inserted under the arm 5 of the joint element 1 until the click joint has been secured. The features of material, the joint element 1 is made of, enable creation of the click joint by means of getting locked together the recess 11 and the undercutting 12, as made in the base arm 7 of the skirting profile element 2.

The joint element 1 may be arranged along the whole straight wall section or according to the conditions, it may be also arranged sectionally, which means that along the whole route of the skirting arrangement many joint elements 1 are fixed, being joints which have the appropriate length and being fixed in selected distances.

What is claimed is:

1. A fixing system for a skirting, said system comprising a skirting profile element and a coupling element, the skirting profile element having an arm to engage the upper surface of floor covering and configured to connect with the coupling element, the arm having a portion extending upwardly towards a wall, in use;

the coupling element comprising a first end portion that is substantially flat and adapted to be located under the floor covering, and a second end portion having a portion extending towards the floor covering, downwardly so that, in use, the downwardly extending portion of the coupling element bears against the upwardly extending portion of the arm to connect the coupling element with and on top of the arm of the skirting profile element, the coupling element being flexible and having a bent portion between the first and second end portions so that, in use, the second end portion can connect with the arm of the skirting profile element in a separable manner.

2. A fixing system as claimed in claim 1, wherein the arm of the skirting profile element and the coupling element are connectable in a snap-fit manner.

3. A fixing system as claimed in claim 1, wherein the coupling element is provided with a reinforcing web.

4. A fixing system as claimed in claim 1, wherein the bent portion of the coupling element has a flattened portion for abutting the wall.

5. A fixing system as claimed in claim 1, wherein the coupling element is provided with flexible inserts.

6. A fixing system for a skirting as claimed in claim 1, wherein the coupling element is provided with a leveling flexible element comprising an end configured to bear against a portion of the floor covering.

7. A fixing system as claimed in claim 1, wherein the arm of the skirting profile element has an upright protrusion for engaging the coupling element.

8. A fixing system as claimed in claim 1, wherein the downwardly extending portion of the second end portion of the coupling element forms a portion of a triangular recess configured to engage with an undercutting formed by the upwardly extending portion of the arm of the skirting profile element to connect the coupling element with and on top of the arm of the skirting profile element.

9. A fixing system as claimed in claim 1, wherein an end of the arm of the skirting profile element is configured to extend in a direction towards the wall.

10. A fixing system as claimed in claim 1, wherein the bent portion is configured to bear against the wall when the coupling element is connected with and on top of the arm of the skirting profile element.

11. A fixing system as claimed in claim 1, wherein the downwardly extending portion of the coupling element further comprises a first engagement surface and the upwardly extending portion of the arm of the skirting profile element further comprises a second engagement surface so that, in use, the first and second engagement surfaces are configured to engage with each other to connect the coupling element with and on top of the arm of the skirting profile element.

12. A fixing system as claimed in claim 11, wherein the first engagement surface is a lower surface on the underside of the coupling element and the second engagement surface is an upper surface on the top of the arm.

* * * * *